US012687099B1

(12) United States Patent
Jin et al.

(10) Patent No.: US 12,687,099 B1
(45) Date of Patent: Jul. 21, 2026

(54) METHOD FOR DESIGNING, MONITORING, AND UPDATING TRAJECTORIES WITH COLLISION AVOIDANCE

(71) Applicant: Schlumberger Technology Corporation, Sugar Land, TX (US)

(72) Inventors: Peng Jin, Beijing (CN); Qing Liu, Beijing (CN); Lu Jiang, Beijing (CN); Samba Ba, Houston, TX (US); Tao Yu, Beijing (CN); Can Jin, Beijing (CN); Magnus A. Hedlund, Houston, TX (US); Jinsoo Kim, Houston, TX (US); Prateek Goel, Houston, TX (US); Darine Mansour, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/199,835

(22) Filed: May 6, 2025

(51) Int. Cl.
*E21B 44/00* (2006.01)
*E21B 7/04* (2006.01)

(52) U.S. Cl.
CPC ..... *E21B 44/00* (2013.01); *E21B 7/04* (2013.01); *E21B 2200/20* (2020.05)

(58) Field of Classification Search
CPC ..... E21B 44/00; E21B 7/04; E21B 2200/20
See application file for complete search history.

(56) References Cited

U.S. PATENT DOCUMENTS

| | | | | |
|---|---|---|---|---|
| 8,794,353 | B2 * | 8/2014 | Benson | E21B 47/12 175/45 |
| 11,933,158 | B2 * | 3/2024 | Benson | E21B 44/02 |
| 2009/0090555 | A1 * | 4/2009 | Boone | E21B 44/00 175/45 |
| 2009/0120690 | A1 * | 5/2009 | Phillips | E21B 47/022 175/45 |
| 2011/0172976 | A1 | 7/2011 | Budiman | |
| 2021/0324727 | A1 | 10/2021 | Hildebrand | |
| 2023/0306168 | A1 | 9/2023 | Jin | |
| 2024/0200429 | A1 | 6/2024 | Liu | |
| 2025/0129709 | A1 | 4/2025 | Ba | |

FOREIGN PATENT DOCUMENTS

| | | | |
|---|---|---|---|
| WO | 2016172006 | A1 | 10/2016 |
| WO | 2018035661 | A1 | 3/2018 |
| WO | 2022187504 | A1 | 9/2022 |

OTHER PUBLICATIONS

Jamieson, A. et al., "Introduction to Wellbore Positioning", University of the Highlands and Islands, 2013, 247 pages.

* cited by examiner

*Primary Examiner* — Blake Michener
(74) *Attorney, Agent, or Firm* — Kyle R. Miiller

(57) ABSTRACT

A method for designing, monitoring, and updating a trajectory of a wellbore at a wellsite. The method includes receiving a plurality of inputs related to the trajectory for the wellbore. The inputs may include a starting point of the trajectory. A zone may be defined within a subsurface beneath the wellsite as safe. The method further includes defining a first set of control points within the zone of the subsurface, and generating a proposed path of the trajectory by connecting the starting point of the trajectory to a plurality of trajectory targets via the first set of control points. The method also includes validating that the proposed path of the trajectory is within the zone of the subsurface.

11 Claims, 9 Drawing Sheets

Traveling Cylinder Plot With Tolerance Lines

METHOD FOR DESIGNING, MONITORING, AND UPDATING TRAJECTORIES WITH COLLISION AVOIDANCE

BACKGROUND

Many wellsites include a number of wells arrayed on a pad, on multiple pads, or instances where there is no pad at all. These pads can be busy and thus make avoiding collisions or promoting an Anti-Collision (AC) workflow challenging. Collision is a risk for well construction. How to avoid intersection with offset wells during operation has been dependent on minimizing the collision risk during the planning phase, monitoring a collision related status during operation, and adaptively re-designing the trajectory the wellbore during operation according to each bottom hole location.

Conventionally, planning and operation were two relatively independent processes, especially in terms of responsible teams and the software utility employed. Both the planning stage and the operation stage have different approaches to handle AC, but both rely on manual trajectory design by an appropriate subject matter expert (SME) when taking into account for no-go zones. Manual adjustment for AC risk may be performed at the wellsite which can be complicated and time-consuming.

What is needed is a new method to automatically modify the trajectory or trajectories to achieve better AC status. This may include scenarios such as when the pad, wellsite, derrick, or other facility is at moderate risk, producing a trajectory design that is compliant with AC standards, and when the pad is very busy, producing a trajectory design that minimizes the risk such as minimal accumulated risk MD interval length, lowest AC severity level, or the like. A framework may be provided on the AC free trajectory design that can be applied to the life cycle of a wellbore trajectory, namely from planning to execution.

SUMMARY

Disclosed are methods, systems, and computer programs for designing and monitoring a trajectory of a wellbore at a wellsite. The method includes receiving a plurality of inputs related to the trajectory for the wellbore. The inputs may include a starting point of the trajectory. The method may also include defining a zone within a subsurface beneath the wellsite as safe, defining a first set of control points within the zone of the subsurface, and generating a proposed path of the trajectory by connecting the starting point of the trajectory to a plurality of trajectory targets via the first set of control points. The method also includes validating that the proposed path of the trajectory is within the zone of the subsurface.

The current disclosure also provides a computing system which includes one or more processors and a memory system having one or more non-transitory computer-readable media storing instructions that, when executed by at least one of the one or more processors, cause the computing system to perform operations. The operations may include receiving a plurality of inputs related to a trajectory for a wellbore. The inputs include a starting point of the trajectory. The operations may also include defining a zone within a subsurface beneath a wellsite as safe, defining a first set of control points within the zone of the subsurface, and generating a proposed path of the trajectory by connecting the starting point of the trajectory to a plurality of trajectory targets via the first set of control points. The operation also includes validating that the proposed path of the trajectory is within the zone of the subsurface and then performing a site action based on the proposed path of the trajectory.

The current disclosure also provides a non-transitory computer-readable medium storing instructions that, when executed by one or more processors of a computing system, cause the computing system to perform operations. The operations include receiving a plurality of inputs related to a trajectory for a wellbore at a wellsite. The inputs may include a starting point, a plurality of trajectory targets, a plurality of paths corresponding to a plurality offset wells comprising related positional uncertainties, and geometric constraints. The geometric constraints in turn may include formation information, drilling tool ability, drilling performance concerns, and production utilities. The operations may also include defining a zone within a subsurface beneath the wellsite as safe, defining a first set of control points within the zone of the subsurface, and generating a proposed path of the trajectory by connecting the starting point to each of the plurality of trajectory targets via the first set of control points. The operations also include validating that the proposed path of the trajectory is within the zone of the subsurface, drilling the wellbore along the proposed path of the trajectory, monitoring a location of the wellbore as it progresses along the proposed path of the trajectory, and then updating the proposed path of the trajectory in real-time when the wellbore is at risk of exiting the zone. Updating the proposed path of the trajectory may include defining a second set of control points within zone of the subsurface. The operations may further include generating an updated proposed path of the trajectory by connecting the location of the wellbore to at least one of the plurality of trajectory targets via the second set of control points, drilling the wellbore along the updated proposed path of the trajectory, and then performing a site action based on the updated proposed path of the trajectory. Performing the site action includes generating or transmitting a signal that instructs or causes an action to occur. The action includes a physical action. The physical action may include selecting where to drill a wellbore in the subsurface formation, drilling the wellbore, varying a trajectory of the wellbore, varying a weight or torque on a drill bit that is drilling the wellbore, varying a rate or concentration of a fluid being pumped into the wellbore, deciding to stop drilling and pull the downhole equipment up before causing a collision with an offset well, or a combination thereof.

BRIEF DESCRIPTION OF THE DRAWINGS

The disclosure is illustrated by way of example, and not by way of limitation in the figures of the accompanying drawings in which like reference numerals are used to refer to similar elements. It is appreciated that various features may not be drawn to scale, and the dimensions of various features may be arbitrarily increased or reduced for clarity of discussion. Further, it is contemplated that features of one or more embodiments may be incorporated in other embodiments without additional recitation.

DETAILED DESCRIPTION

Reference will now be made in detail to embodiments, examples of which are illustrated in the accompanying drawings and figures. In the following detailed description, numerous specific details are set forth in order to provide a thorough understanding of the disclosed technology. However, it will be apparent to one of ordinary skill in the art that the disclosed embodiments may be practiced without these specific details. In other instances, well-known methods, procedures, components, circuits, and networks have not been described in detail so as not to unnecessarily obscure aspects of the embodiments.

It will also be understood that, although the terms first, second, etc., may be used herein to describe various elements, these elements should not be limited by these terms. These terms are used to distinguish one element from another. For example, a first object or step could be termed a second object or step, and, similarly, a second object or step could be termed a first object or step, without departing from the scope of the disclosure. The first object or step, and the second object or step, are both objects or steps, respectively, but they are not to be considered the same object or step.

The terminology used in the description of the disclosed techniques is for the purpose of describing particular embodiments and is not intended to be limiting. As used in the description of this disclosure and the appended claims, the singular forms "a," "an" and "the" are intended to include the plural forms as well, unless the context clearly indicates otherwise. It will also be understood that the term "and/or" as used herein refers to and encompasses any combination of one or more of the associated listed items. It will be further understood that the terms "includes," "including," "comprises" and/or "comprising," when used in this disclosure, specify the presence of stated features, integers, steps, operations, elements, and/or components, but do not preclude the presence or addition of one or more other features, integers, steps, operations, elements, components, and/or groups thereof.

As used herein, the term "if" may be construed to mean "when" or "upon" or "in response to determining" or "in response to detecting," depending on the context.

Those with skill in the art will appreciate that while some terms in this disclosure may refer to absolutes, e.g., all of the components of a wavefield, all source receiver traces, each of a plurality of objects, etc., the methods and techniques disclosed herein may also be performed on fewer than all of a given thing, e.g., performed on one or more components and/or performed on one or more source receiver traces. Accordingly, in instances in the disclosure where an absolute is used, the disclosure may also be interpreted to be referring to a subset.

System Overview

Figure 1:
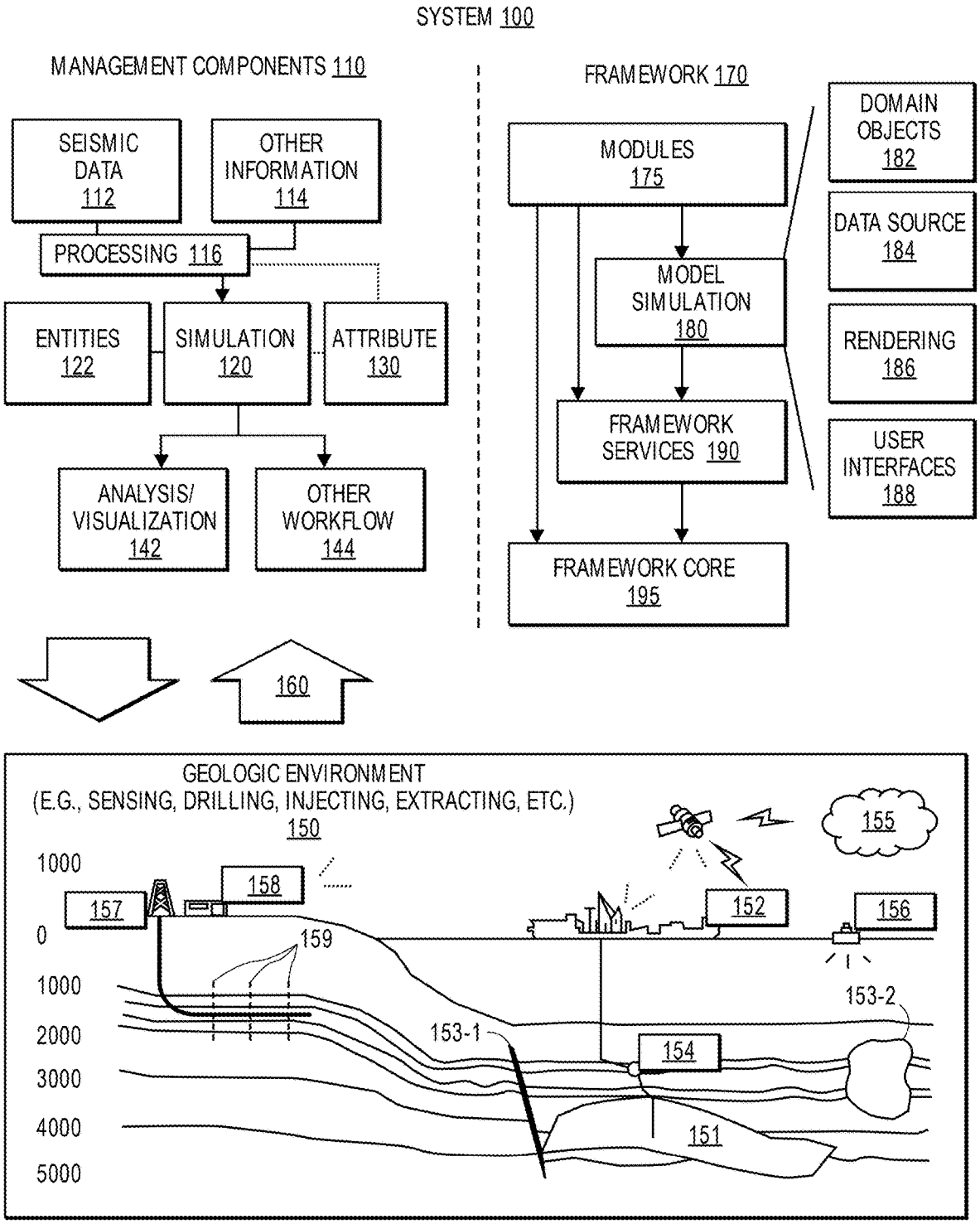
FIG. 1 illustrates an example of a system that includes various management components to manage various aspects of a geologic environment, according to an embodiment.

FIG. 1 illustrates an example of a system 100 that includes various management components 110 to manage various aspects of a geologic environment 150 (e.g., an environment that includes a sedimentary basin, a reservoir 151, one or more faults 153-1, one or more geobodies 153-2, etc.). For example, the management components 110 may allow for direct or indirect management of sensing, drilling, injecting, extracting, etc., with respect to the geologic environment 150. In turn, further information about the geologic environment 150 may become available as feedback 160 (e.g., optionally as input to one or more of the management components 110).

In the example of FIG. 1, the management components 110 include a seismic data component 112, an additional information component 114 (e.g., well/logging data), a processing component 116, a simulation component 120, an attribute component 130, an analysis/visualization component 142 and a workflow component 144. In operation, seismic data and other information provided per the components 112 and 114 may be input to the simulation component 120.

In an example embodiment, the simulation component 120 may rely on entities 122. Entities 122 may include earth entities or geological objects such as wells, surfaces, bodies, reservoirs, etc. In the system 100, the entities 122 can include virtual representations of actual physical entities that are reconstructed for purposes of simulation. The entities 122 may include entities based on data acquired via sensing, observation, etc. (e.g., the seismic data 112 and other information 114). An entity may be characterized by one or more properties (e.g., a geometrical pillar grid entity of an earth model may be characterized by a porosity property). Such properties may represent one or more measurements (e.g., acquired data), calculations, etc.

In an example embodiment, the simulation component 120 may operate in conjunction with a software framework such as an object-based framework. In such a framework, entities may include entities based on pre-defined classes to facilitate modeling and simulation. A commercially available example of an object-based framework is the MICROSOFT®.NET© framework (Redmond, Washington), which provides a set of extensible object classes. In the .NET® framework, an object class encapsulates a module of reusable code and associated data structures. Object classes can be used to instantiate object instances for use in by a program, script, etc. For example, borehole classes may define objects for representing boreholes based on well data.

In the example of FIG. 1, the simulation component 120 may process information to conform to one or more attributes specified by the attribute component 130, which may include a library of attributes. Such processing may occur prior to input to the simulation component 120 (e.g., consider the processing component 116). As an example, the simulation component 120 may perform operations on input information based on one or more attributes specified by the attribute component 130. In an example embodiment, the simulation component 120 may construct one or more models of the geologic environment 150, which may be relied on to simulate behavior of the geologic environment 150 (e.g., responsive to one or more acts, whether natural or artificial). In the example of FIG. 1, the analysis/visualization component 142 may allow for interaction with a model or model-based results (e.g., simulation results, etc.). As an example, output from the simulation component 120 may be input to one or more other workflows, as indicated by a workflow component 144.

As an example, the simulation component 120 may include one or more features of a simulator such as the ECLIPSET™ reservoir simulator (SLB, Houston Texas), the INTERSECT™ reservoir simulator (SLB, Houston Texas), etc. As an example, a simulation component, a simulator, etc. may include features to implement one or more meshless techniques (e.g., to solve one or more equations, etc.). As an example, a reservoir or reservoirs may be simulated with respect to one or more enhanced recovery techniques (e.g., consider a thermal process such as SAGD, etc.).

In an example embodiment, the management components 110 may include features of a commercially available framework such as the PETREL® seismic to simulation software framework (SLB, Houston, Texas). The PETREL® framework provides components that allow for optimization of exploration and development operations. The PETREL® framework includes seismic to simulation software components that can output information for use in increasing reservoir performance, for example, by improving asset team productivity. Through use of such a framework, various professionals (e.g., geophysicists, geologists, and reservoir engineers) can develop collaborative workflows and integrate operations to streamline processes. Such a framework may be considered an application and may be considered a data-driven application (e.g., where data is input for purposes of modeling, simulating, etc.).

In an example embodiment, various aspects of the management components 110 may include add-ons or plug-ins that operate according to specifications of a framework environment. For example, a commercially available framework environment marketed as the OCEAN® framework environment (SLB, Houston, Texas) allows for integration of add-ons (or plug-ins) into a PETREL® framework workflow. The OCEAN® framework environment leverages .NET® tools (Microsoft Corporation, Redmond, Washington) and offers stable, user-friendly interfaces for efficient development. In an example embodiment, various components may be implemented as add-ons (or plug-ins) that conform to and operate according to specifications of a framework environment (e.g., according to application programming interface (API) specifications, etc.).

FIG. 1 also shows an example of a framework 170 that includes a model simulation layer 180 along with a framework services layer 190, a framework core layer 195 and a modules layer 175. The framework 170 may include the commercially available OCEAN® framework where the model simulation layer 180 is the commercially available PETREL® model-centric software package that hosts OCEAN® framework applications. In an example embodiment, the PETREL® software may be considered a data-driven application. The PETREL® software can include a framework for model building and visualization. In certain embodiments, the framework 170 may include additional cloud-based applications such as DrillPlan, DrillOps Rig, DrillOps Town, or other application which may be used for planning, execution, and remote monitoring phases of a site.

As an example, a framework may include features for implementing one or more mesh generation techniques. For example, a framework may include an input component for receipt of information from interpretation of seismic data, one or more attributes based at least in part on seismic data, log data, image data, etc. Such a framework may include a mesh generation component that processes input information, optionally in conjunction with other information, to generate a mesh.

In the example of FIG. 1, the model simulation layer 180 may provide domain objects 182, act as a data source 184, provide for rendering 186 and provide for various user interfaces 188. Rendering 186 may provide a graphical environment in which applications can display their data while the user interfaces 188 may provide a common look and feel for application user interface components.

As an example, the domain objects 182 can include entity objects, property objects and optionally other objects. Entity objects may be used to geometrically represent wells, surfaces, bodies, reservoirs, etc., while property objects may be used to provide property values as well as data versions and display parameters. For example, an entity object may represent a well where a property object provides log information as well as version information and display information (e.g., to display the well as part of a model).

In the example of FIG. 1, data may be stored in one or more data sources (or data stores, generally physical data storage devices), which may be at the same or different physical sites and accessible via one or more networks. The model simulation layer 180 may be configured to model projects. As such, a particular project may be stored where stored project information may include inputs, models, results and cases. Thus, upon completion of a modeling session, a user may store a project. At a later time, the project can be accessed and restored using the model simulation layer 180, which can recreate instances of the relevant domain objects.

In the example of FIG. 1, the geologic environment 150 may include layers (e.g., stratification) that include a reservoir 151 and one or more other features such as the fault 153-1, the geobody 153-2, etc. As an example, the geologic environment 150 may be outfitted with any of a variety of sensors, detectors, actuators, etc. For example, equipment 152 may include communication circuitry to receive and to transmit information with respect to one or more networks 155. Such information may include information associated with downhole equipment 154, which may be equipment to acquire information, to assist with resource recovery, etc. Other equipment 156 may be located remote from a well site and include sensing, detecting, emitting or other circuitry. Such equipment may include storage and communication circuitry to store and to communicate data, instructions, etc. As an example, one or more satellites may be provided for purposes of communications, data acquisition, etc. For example, FIG. 1 shows a satellite in communication with the network 155 that may be configured for communications, noting that the satellite may additionally or instead include circuitry for imagery (e.g., spatial, spectral, temporal, radiometric, etc.).

FIG. 1 also shows the geologic environment 150 as optionally including equipment 157 and 158 associated with a well that includes a substantially horizontal portion that may intersect with one or more fractures 159. For example, consider a well in a shale formation that may include natural fractures, artificial fractures (e.g., hydraulic fractures) or a combination of natural and artificial fractures. As an example, a well may be drilled for a reservoir that is laterally extensive. In such an example, lateral variations in properties, stresses, etc. may exist where an assessment of such variations may assist with planning, operations, etc. to develop a laterally extensive reservoir (e.g., via fracturing, injecting, extracting, etc.). As an example, the equipment 157 and/or 158 may include components, a system, systems, etc. for fracturing, seismic sensing, analysis of seismic data, assessment of one or more fractures, etc.

As mentioned, the system 100 may be used to perform one or more workflows. A workflow may be a process that includes a number of worksteps. A workstep may operate on data, for example, to create new data, to update existing data, etc. As an example, a may operate on one or more inputs and create one or more results, for example, based on one or more algorithms. As an example, a system may include a workflow editor for creation, editing, executing, etc. of a workflow. In such an example, the workflow editor may provide for selection of one or more pre-defined worksteps, one or more customized worksteps, etc. As an example, a workflow may be a workflow implementable in the PETREL® software, for example, that operates on seismic data, seismic attribute(s), etc. As an example, a workflow may be a process implementable in the OCEAN® framework. As an example, a workflow may include one or more worksteps that access a module such as a plug-in (e.g., external executable code, etc.).

Method for Adjusting a Trajectory Design for Collision Avoidance

The current disclosure includes a method to optimize single or multiple trajectories, reducing the collision risk. For real-time AC free trajectory design, a tolerance tunnel may be used as an allowable safe space and to limit the design within the tunnel instead of conventional plan-validate-update loops used in collision free trajectory planning. The current workflow may automatically and adaptively generate as many collision free working trajectory candidates as requested by representing the subspace with labelled zones and then identify optimal control points and connect them with professional trajectories. A safety validator may be created to quickly evaluate if an updated trajectory is collision free for monitoring purposes. In addition, the workflow may also include a tailored ranking system that may rank proposed working trajectory candidates based on the calculated collision risk and other factors.

In certain embodiments, for a new pad with no existing wells, any trajectory for any new planned well may be evaluated against all existing offset wells and then optimized accordingly. For a pad with existing wells, the existing wells may also be included with the offset wells for the evaluation of trajectory(ies) under planning, but are not further optimized or moved. Similarly, for a pad with existing wells and pre-existing definitive plans, the existing wells and definitive plans may be included as offset wells for the evaluation of trajectory(ies) under planning, but are not further optimized or moved. In certain embodiments, the definitive plan may be included as a primary well for AC evaluation against all its offset wells as is further discussed below. In certain embodiments, an initial plan or trajectory may be adjusted and then fed into additional downstream optimization methods.

The workflow may consume an initial design of the trajectory(ies) and then split the trajectory(ies) based on a AC risk severity level or score computed following the a AC generation process, each section of the split trajectory having an associated AC vector which is averaged from the vector pointing from an offset well to the current or considered well. By moving the path of the trajectory along the AC vector defined in this way, the risky trajectory intervals and severity level can be effectively reduced, which may result in a better AC status or classification. The current workflow may help adaptively optimize the trajectory of the planned well for anti-collision based on an initial or a default set of trajectories with consideration for existing wells and other engineering constraints.

According to certain embodiments, the current workflow optimizes a single path or multiple paths for a trajectory to balance the need to minimize the collision risk. The workflow may include moving control points within the planned or proposed trajectory path based on a pseudo-force method to adjust the trajectory(ies). In certain embodiments, the movable elements along the path of the trajectory(ies) may be elements that have a decisive influence on the trajectory profile. They may be on the path of the trajectory(ies), however in certain other embodiments they may not be on the path of the trajectory(ies). In one particular example, at least one of the movable elements may be a "joint point."

Figure 2:
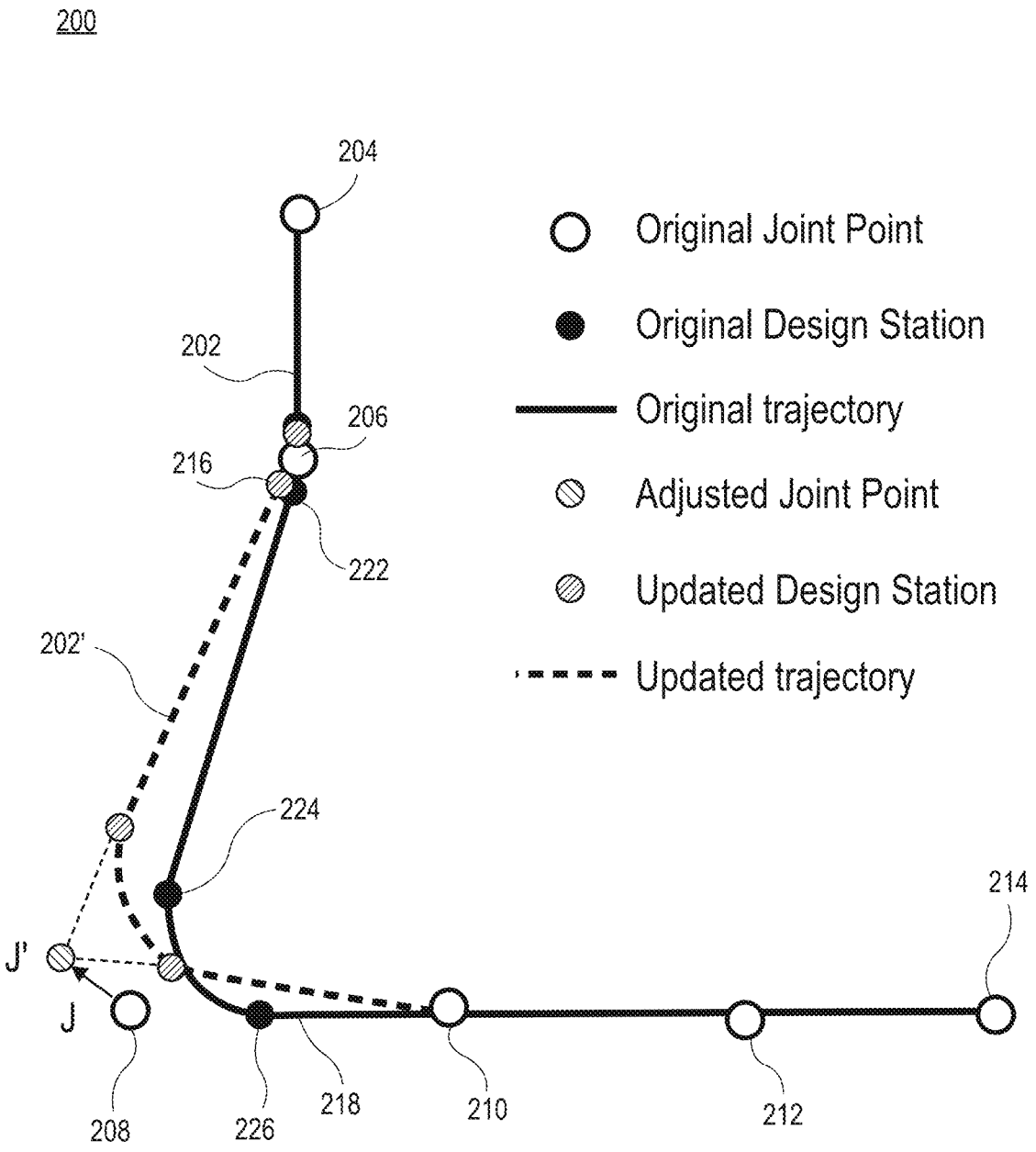
FIG. 2 illustrates a trajectory of a well and movement of a joint point related to the trajectory within a graphical interface, according to an embodiment.

In certain embodiments, the Minimum Curvature (MC) computational method may be used to design the planned path of the trajectory(ies). As seen in FIG. 2, a graphical interface 200 may be provided for a curve of the initial path of a trajectory 202. A series of "joint points" 204-214 may be introduced, with at least one joint point 204, 214 introduced at the intersection of the tangential line at the beginning and end of the trajectory 202. The existence of at least one joint point 204-214 has been guaranteed by the nature of the MC arc defining the trajectory 202. Also defined along the path of the trajectory 202 are a plurality of design stations 222-226. In FIG. 2, at least one joint point 208 does not lie on the corresponding curve or on the path of the trajectory 202, yet it has a determining influence. Instead of modifying a curve by freedoms (such as position and direction) at the designed stations 222-226, the joint point 208 may be employed as an additional variable control point in the algorithm. FIG. 2 shows how a joint point adjustment will affect the path of the trajectory in design. Each joint point 204-214 can move freely in 3-D space independently. For example, joint point 208 may be moved from position J next to a landing point 218 at position J'. In response, the profile of the path of the trajectory 202 may produce an updated or adjusted path of the trajectory 202', the adjusted path of the trajectory 202' being limited to the parts between a kick off point (KOP) 216 and a landing point 218 of the initial path of the trajectory 202. The remaining portions of the initial path of the trajectory 202 either before the KOP 216 and after the landing point 218 may remain original or unchanged.

According to certain embodiments, the movement of each of the moveable elements may be constrained. For example, the KOP 216 may only move up or down along a vertical portion of the path of the trajectory 202. In certain embodiments, the landing point 218 may be adjusted along a horizontal portion or landing line of the path of the trajectory 202. In certain embodiments, predefined sections of the path of the trajectory 202 may be included as key elements. Generally, trajectories computed using the minimum curvature method may be designed by design sections, the sections being a series of curve-hold combinations with configurable parameters. For example, the path of the trajectory 202 may include a three dimensional profile made up of a curve-hold-curve sequence that includes a configurable dog leg severity input and ending position plus ending direction. According to certain embodiments, the movable elements may include an ending point with 3 degrees of freedom (DOF) of movement. If the design section of the path of the trajectory 202 includes a starting portion which extends vertically from the surface location as seen in FIG. 2, the KOP 216 in the vertical segment may function as a movable element with only one degree of freedom along the vertical depth.

According to certain embodiments, the pseudo-force-based trajectory optimization method of the current workflow may be tailored for collision-free pad wells. When a segment of one designed path of the trajectory for one planned wellbore has a certain collision risk, it can be assumed that there is a "pseudo-force" like element which pushes the planned path of the trajectory in order to keep moving it away from any corresponding offset wells until the planned path of the trajectory is "balanced," or where no collision risks are present. This pseudo-force-induced moving vector may be computed by combining the directions pointing from the offset wells to the subject planned well. The directions can be either a direct average of all AC records' center-to-center directions, or a weighted sum according to AC severity levels in certain embodiments. In some challenging cases, a new design section may be inserted into the trajectory design of the planned well to ensure enough freedom to achieve a collision-free solution.

Figure 4A:
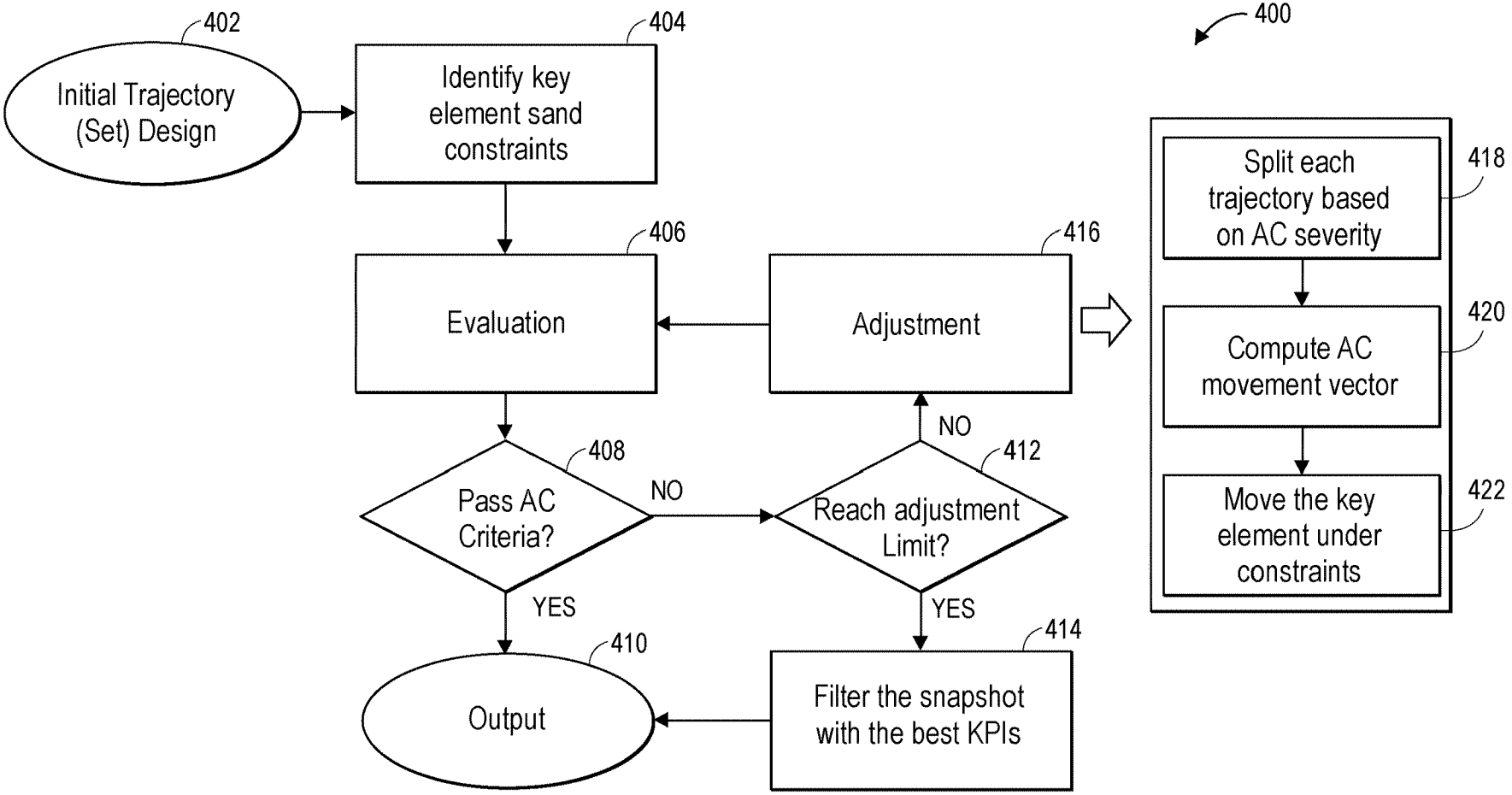
FIG. 4A illustrates a workflow for designing a trajectory for a well, according to an embodiment.
Figure 4B:
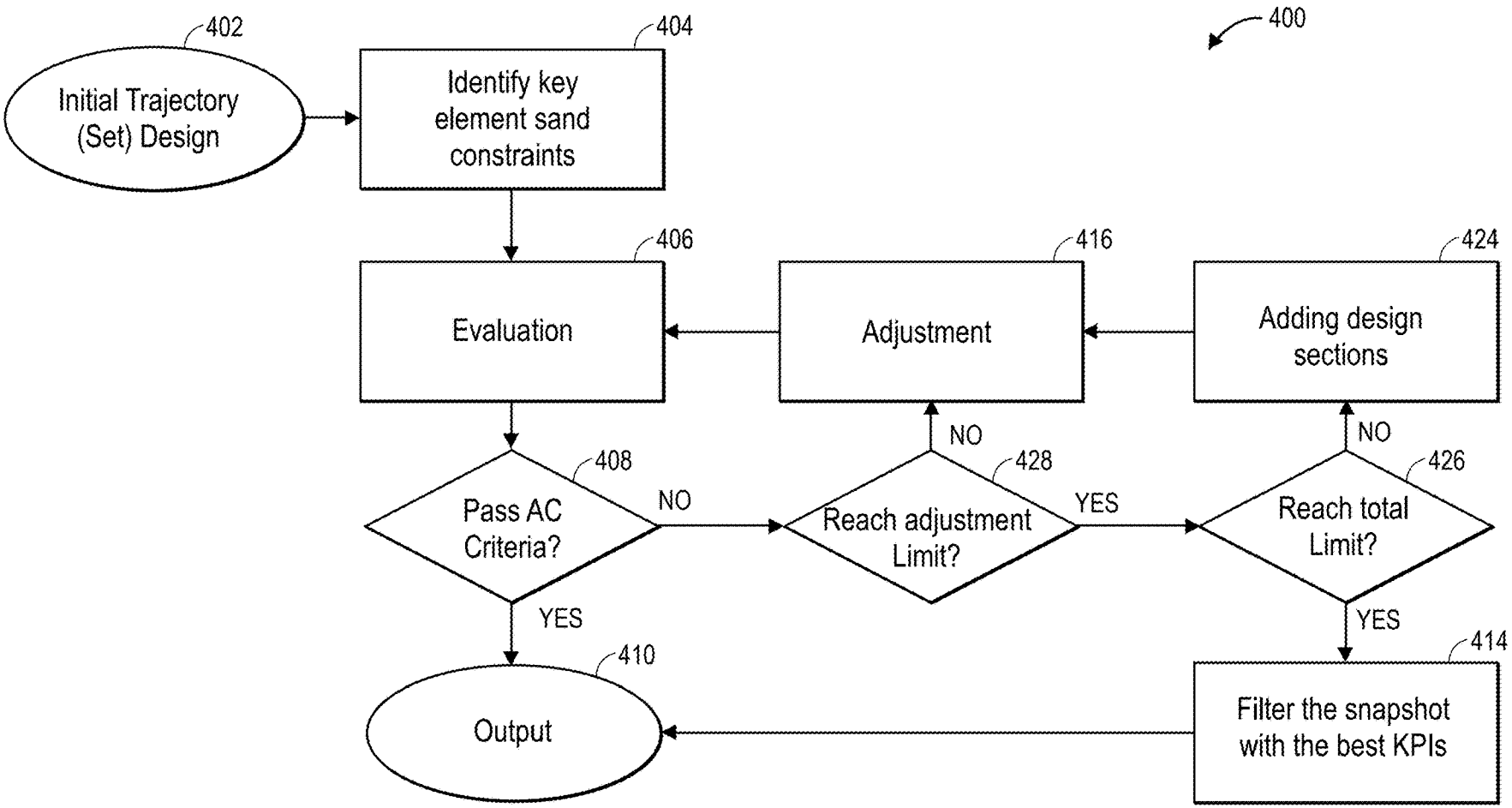
FIG. 4B illustrates a workflow for designing a trajectory for a well incorporating adding additional design sections to the trajectory, according to an embodiment.

According to certain embodiments, the current workflow 400 as seen in FIGS. 4A-4B may include providing an initial path of the trajectory design at step 402, and then identifying key elements and constraints for the initial path of the trajectory design at step 404 such as described above with reference to FIG. 2. The workflow 400 may also include defining a movable element along the planned path of the trajectory(ies), and then performing either a standard or alternative anti-collision analysis or evaluation at step 406 on the planned path of the trajectory.

Returning to FIGS. 4A-4B, and according to certain embodiments, the workflow 400 may include evaluating the proposed or initial path of the trajectory by assigning the initial path of the trajectory an AC score or risk assessment and then comparing it to a stopping criteria at step 408. If the stopping criteria is not satisfied at step 408, for example the calculated AC risk for the initial path of the trajectory does not reach a predetermined threshold, the workflow 400 may be iterated upon again provided that the workflow 400 has not been iterated beyond a predetermined iteration limit at step 412. If, however, the calculated AC risk does reach the predetermined threshold, the proposed path of the trajectory is output or displayed on a screen as a designed path of the trajectory at step 410. If the workflow 400 has been repeatedly iterated upon and has reached the predetermined iteration limit at step 412, the best key performance indicators (KPIs) may be filtered from the plurality of workflow iterations at step 414. If however the number of workflow 400 iterations has not reached the predetermined iteration limit at step 412, the initial path of the trajectory may be further adjusted within an adjustment step 416. In certain embodiments, the initial path of the trajectory may be adjusted within the adjustment step 416 by splitting the path of the trajectory based on an AC risk severity at step 418, computing an AC movement vector at step 420, moving a key element of the path of the trajectory under defined constraints at step 422, or a combination thereof.

In certain embodiments, the anti-collision analysis may automatically and adaptively generate as many as requested collision free working trajectory candidates by representing a defined subspace with labelled zones, identifying optimal control points within a defined safe zone, and then connecting the control points with professional trajectories. A safety validator may be created to quickly evaluate if an updated path of the trajectory is collision free for monitoring purposes. In addition and according to certain embodiments, a tailored ranking system may be added that will rank proposed working path of the trajectory candidates based on a corresponding collision risk and other factors.

According to certain embodiments, the planned path of the trajectory may be split according to an AC severity that may be calculated by AC rules known in the art at step 418. For each section, an AC movement vector may be computed and assigned to move the movable elements of the path of the trajectory. The movable elements may be moved along an allowable direction under specific constraints. The allowable movement direction may be defined directly by the AC movement vector, while the moving distance can be either defined by a fixed amount or by following an appropriate methodology.

In certain embodiments, the AC movement vector may be computed so that is pointing from the offset well to the planned path of the trajectory of the subject well, which can be averaged from each AC movement vector of each offset well's center-to-center direction relative to the planned path of the trajectory of the subject well at step 420. In certain embodiments, the AC movement vector can be either a direct average in cases when the weight is discretized by AC severity level and the weight numbers along the section of the planned path of the trajectory share the same magnitude within the section, or a weighted average if a continuous value of the indicator is adopted. A direct average movement vector of AC section S against offset O can be seen in FIG. 3A and expressed as follows in equation 1:

$$\vec{v_S} = \frac{1}{n}\sum_{i\in S}\vec{d_i} \tag{1}$$

In equation 1 above, $\vec{d_i}$ is a normalized vector 306 pointing from an offset well 304 to the subject well 302 for AC record i. In special cases, this formula will result in a zero vector when the offset wells are symmetry disposed around the planned subject well and hence a deadlock scenario will emerge. To avoid the deadlock during iteration, an extra disturbance may be added to the movement vector in the current implementation as seen in equation 2:

$$\vec{v_S}^{*} = \vec{v_S} + \vec{\epsilon} \tag{2}$$

Figure 3B:
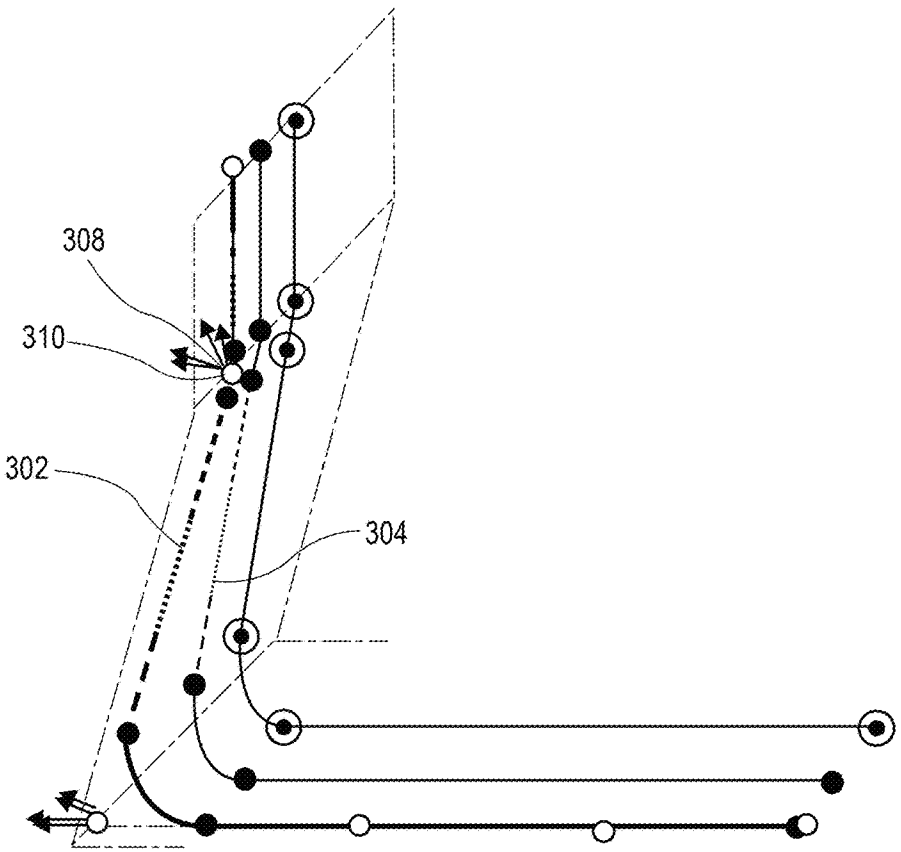
FIG. 3B illustrates an anti-collision vector assigned to moveable elements along the trajectory for a well seen in FIG. 3A, according to an embodiment.
Figure 3A:
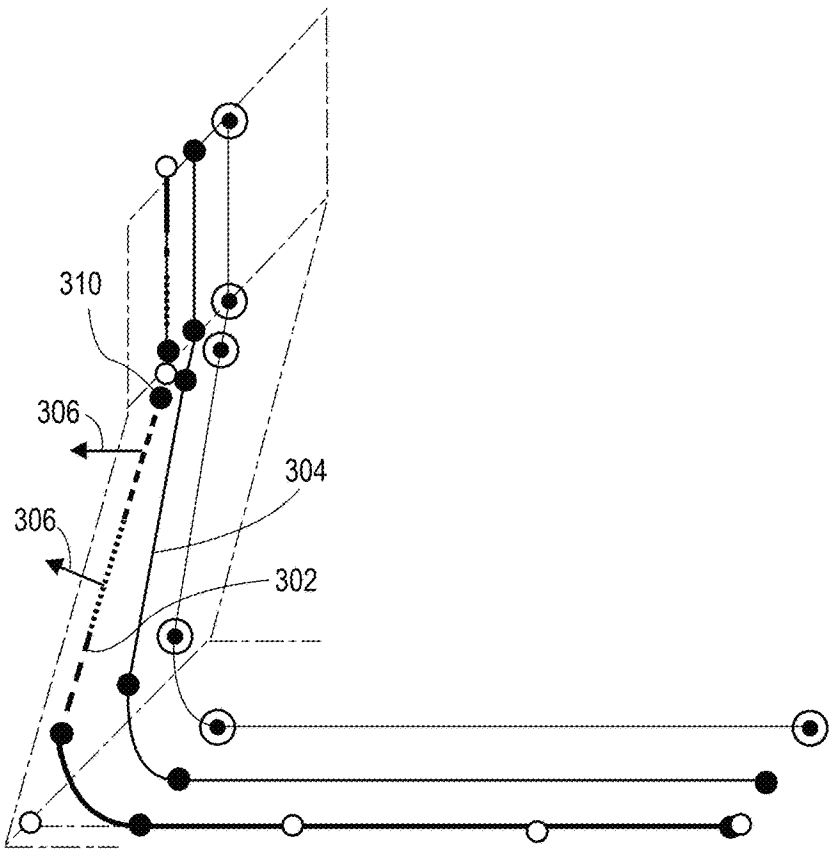
FIG. 3A illustrates an anti-collision vector applied to a trajectory for a well, according to an embodiment.

The movement vector 308 for each section may be applied to the moveable elements 310 and aggregated as seen in FIG. 3B. According to certain embodiments, the magnitude of the movement vector 308 may be adjustable during or between each iterations of the workflow 400.

Returning to FIG. 4A, in certain embodiments the movement of the movable elements may be further modified according to some design constraints at step 422. For example, sometimes the path of the trajectory needs to include a long vertical section where both the starting point and ending point of the vertical section may have 3-DOF, however, moving two of the movable elements independently may break the constraint of the vertical section. Thus, additional modifications to ensure such requirements are satisfied may be needed.

In certain embodiments as seen in FIG. 4B, if the workflow 400 has reached a maximum number of adjustment iterations at step 428, but no satisfying result comes out, a new design section may be inserted into the proposed path of the trajectory design at step 424 while keeping the overall profile of the proposed path of the trajectory the same. The entire workflow process 400 may then be repeated from the beginning. In certain embodiments, if new design sections have been repeatedly added to the selected path of the trajectory and the path of the trajectory has reached a predetermined design limit at step 426, the best key performance indicators (KPIs) may be filtered from the plurality of workflow iterations at step 414. If however the number of workflow 400 iterations has not reached the predetermined design limit at step 426, the proposed or selected path of the trajectory may continue to have new design sections added at step 424. In certain embodiments, the best or most optimal proposed path of the trajectory computed from the workflow iterations may then be displayed on a screen as the design path of the trajectory at step 410.

Method for Designing and Monitoring Trajectories with Collision Avoidance

Figure 5:
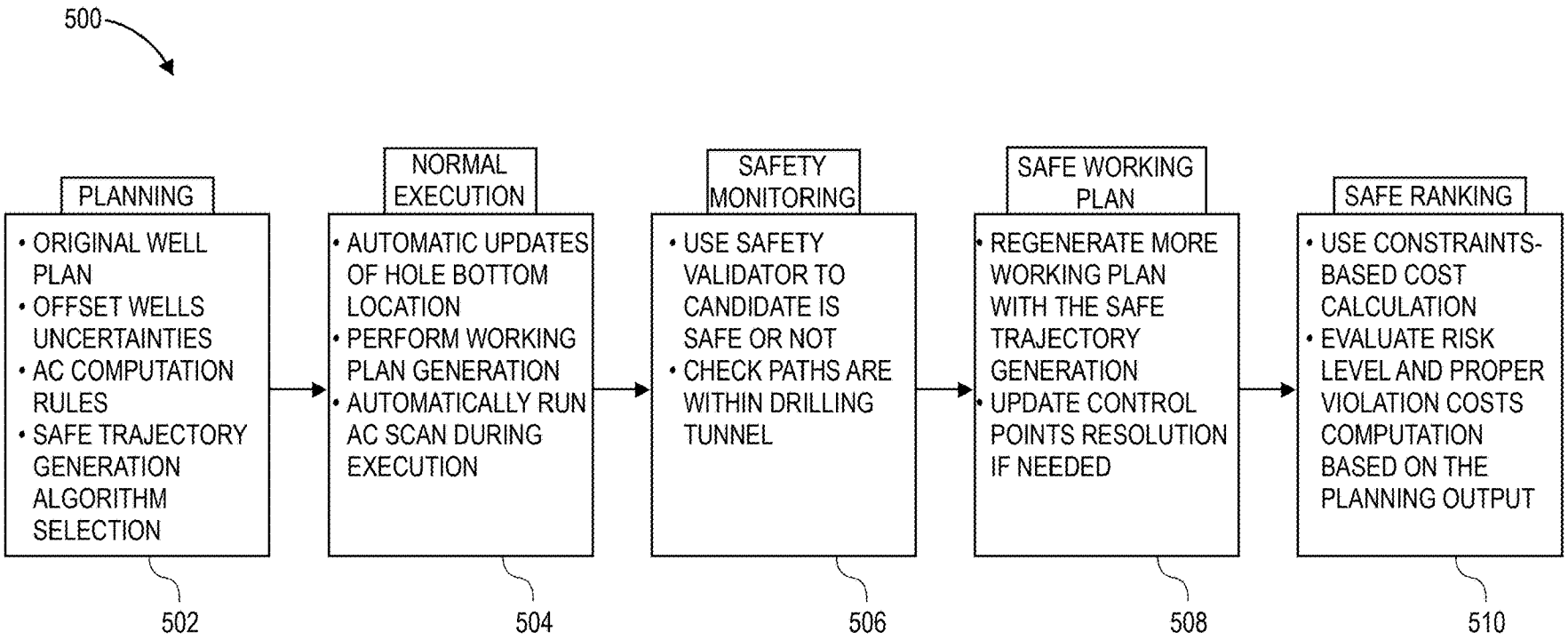
FIG. 5 illustrates a sub-workflow for generating a collision free trajectory from a planning phase to a safe ranking phase, according to an embodiment.

According to certain embodiments, the evaluation 406 may include a sub-workflow 500 as seen in FIG. 5. The sub-workflow 500 may include a planning phase 502 followed by an execution phase 504.

In certain embodiments, the planning phase 502 includes providing inputs for the planned path of the trajectory of a subject well, the inputs including but not limited to a starting surface location, trajectory targets, geometric constraints, offset well paths with a related positional uncertainty, a known or pre-existing anti-collision computation rule, or a combination thereof. In certain embodiments, geometric constraints may include formation information, drilling tool ability, drilling performance concerns, and production utilities such as trajectory shape or profile, kickoff point, dog leg severity (DLS), or specific direction limitations for specific intermediate points or parts, or a combination thereof. In certain embodiments, the inputs provided during the planning phase 502 may be other local environmental information which may include places that a path of the trajectory of the subject well should not go including but not limited to seismic faults, water zones, and the like.

The planning phase 502 may also include generating one or more well trajectories, each path of the trajectory having a minimized AC risk. In certain embodiments, the planning phase 502 may include using a safe trajectory generator. In certain embodiments, the safe trajectory generator may introduce a structured workflow that may enhance well path planning using a subspace representation with associated risk levels. In certain embodiments, planned starting points of the trajectory, for example a starting point on the surface, tie-in points or point ties to a drilled wellbore, or bottom hole locations, may be known. Additionally, targets may be defined based on the trajectory positions of nearby offset wells, including corresponding uncertainty information. In certain embodiments, the targets to be hit by the path of the trajectory of the subject well may or may include specific directions. The subspace that the planned path of the trajectory traverses through may be represented with risk levels such as safe, unsafe, and warning zones.

Figure 6:
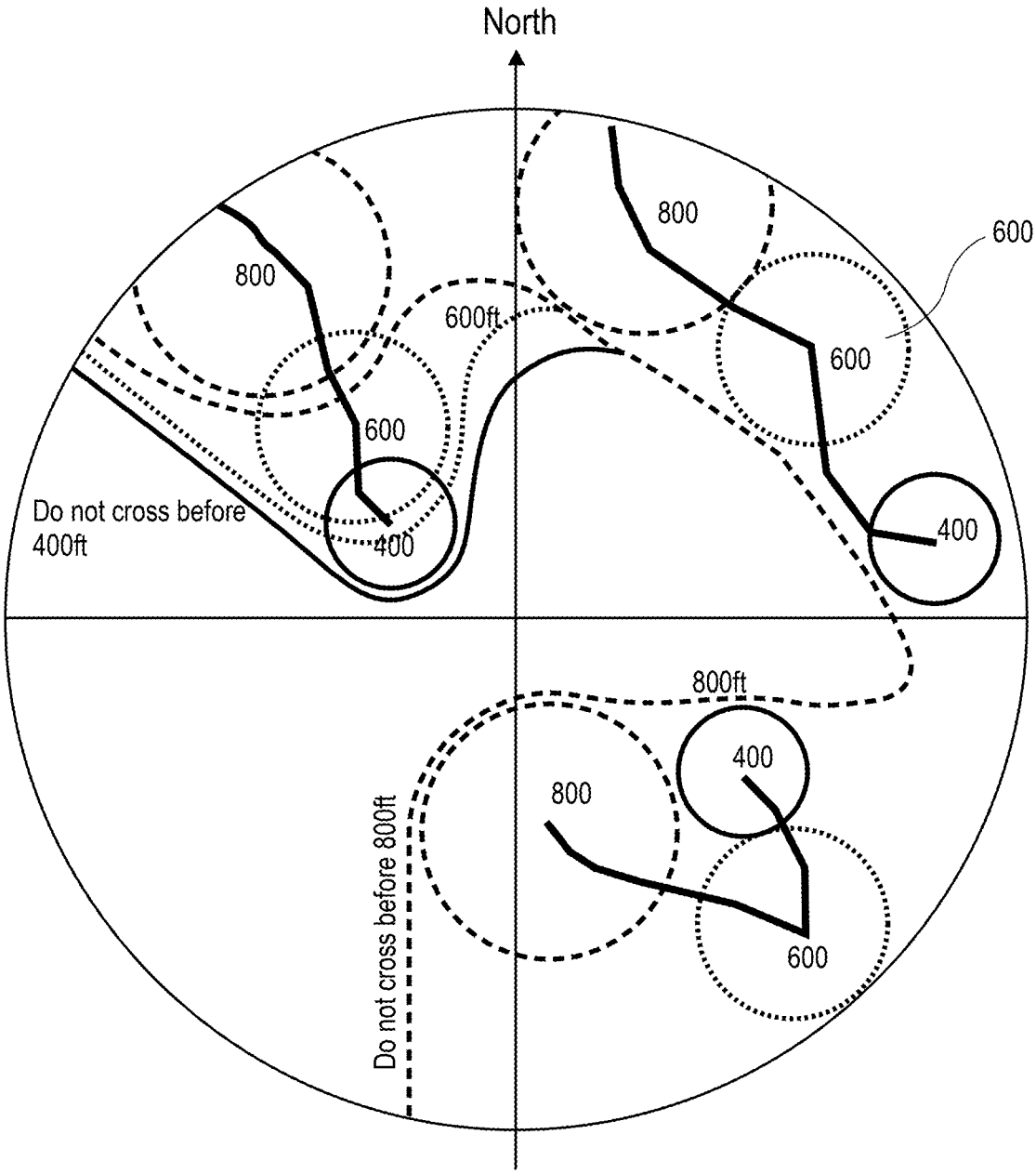
FIG. 6 illustrates a traveling cylinder plot with tolerance lines, according to an embodiment.

In certain embodiments, subspace representation may include a tolerance line with a depth range for the subject well. The tolerance tunnel may define a distorted column of space around the planned path of the trajectory of the subject well. The tolerance line can be either drawn manually or automatically generated. In certain embodiments, the tolerance line may be expanded so as to form a tolerance tunnel 600, which as seen in FIG. 6 is a 3D spatial corridor within which the planned path of the trajectory must remain. The tolerance tunnel 600 may represent an acceptable deviation range for the wellbore path of the trajectory by defining a corridor in the dimensions along the path plus the cross-sectional plane.

According to certain embodiments, the safe trajectory generator may include optimal control point identification where a set of control points may be defined inside a determined safe zone to effectively to guide the planned path of the trajectory. In certain embodiments, the optimal control point identification can be generated by performing a grid search inside the safe zones using some strategy, or by guiding by a baseline in 3D space. Additional constraints can be applied to filter the initial control points. In certain embodiments and during real-time operation, the additional constraints may be the steerability of BHA tools, a current starting position and direction, a target position and direction, and additional constraints for other drilling risks such as shock and vibration, stick and slip, penetration capacity for current formation, and the like.

According to certain embodiments, the safe trajectory generator may include professional drilling profiles. The professional drilling profiles may generate the path of the trajectory for the planned well by connecting a starting point, one or control points to be disposed along the path of the planned path of the trajectory, and targets of the planned path of the trajectory in order to satisfy any input constraints and trajectory computation algorithms. In certain embodiments, the professional drilling profiles ensure that the generated path of the trajectory(ies) is/are feasible for drilling operations. The resulting path of the trajectory may be validated against the safety constraint at best. Additionally, the planned path of the trajectory should follow other constraints such as directional constraints added by the user.

According to certain embodiments, when needed, the planned path of the trajectory may be validated or confirmed to be within a designated safe zone. In certain embodiments, a safety validator may be used to validate if a working plan/point is safe. By definition, a working plan/point may be safe if its projection on the travelling cylinder (TC) is inside the tolerance tunnel. In certain embodiments, the tolerance tunnel may include a buffer zone to be more conservative. If needed, the process of finding feasible control points for the planned path of the trajectory, connecting the control points within a safe zone, and validating the planned path of the trajectory may be repeated for as many results that are requested.

According to certain embodiments, a designer of the planned path of the trajectory, for example a drilling engineer, would likely want to implement a planned path of the trajectory which has either no collision risk or a minimized risk that is based on which further optimization/filtering has the possibility to take place or which has been taken into account during the design of the initial path of the trajectory. For example, obtaining a path of the trajectory with less total length, better torque and drag behavior, better hydraulic results, and/or better efficiency for well construction operation may be desired. Due to the possible optimization options discussed above, in many scenarios, a certain number of candidate trajectories may be output, each with different geometric diversity, for example shape profiles, intermediate directions, curvatures, and the like.

In certain embodiments, when one optimized path of the trajectory has been selected as the definitive plan to be executed, a standard collision risk scan along the path of the trajectory may be done according to industry standard process. The designer or drilling engineer may refer to the detailed AC evaluation or risk assessment to specify the high risk segments along the path, which normally starts from where a collision risk, either a warning or a fail, begins, and ends at where the status gets passed. These segments may be denoted as a travelling cylinder (in a projected 2D map) or a tolerance tunnel (in a projected 3D map). In certain embodiments, such a tolerance tunnel may define a 'safe zone' for the operator. As long as the actual drilled path of the trajectory is inside this tolerance tunnel, the operation may be considered safe or with a low collision risk.

Returning to FIG. 5, the sub-workflow 500 may also include an execution phase 504. Due to the integration of well construction platforms between planning and operation, the selected path of the trajectory along with its corresponding tolerance tunnel may be transferred to the real-time operation applications at the wellsite, together with offset well information and AC rules. As it is normal that the actual path of the trajectory of the well cannot be identical to the planned smooth path of the selected path of the trajectory and operators may need to adjust the path of the trajectory at the scale of a drilling stand, for example 30m or 100 ft normally. Traditionally, this adjustment has been done by the operator manually. According to certain embodiments, there are multiple ways for the operator to validate the AC status of the trajectory in real time, for example running a new AC scan with the updated real time path of the trajectory, and validating if the updated real time path of the trajectory is inside the tolerance tunnel as discussed above with regard to the planning phase 502.

In certain embodiments, the execution phase 504 further includes updating any initial inputs as drilling along the planned path of the trajectory progresses. For example, environmental information or geometric constraints may change as drilling progresses, therefore adjustments or revisions should be made to the planned path of the trajectory to compensate for such changes. In certain embodiments, the starting point for the planned path of the trajectory may be a bottom hole location of a pre-existing wellbore. In certain embodiments, the first set of targets that were used as inputs during the planning phase 502 may be updated in real-time during the execution phase 504 as wellbore conditions change. Additionally, a second set of targets may be applied to the planned path of the trajectory as the wellbore is being drilled in real time, the second set of targets being separate from the first set of targets used during the planning phase 502.

According to certain embodiments, the sub-workflow 500 may also include a safety monitoring phase 506 during the drilling process of the selected path of the trajectory. In certain embodiments, a safety validator may be run for the real time updated path of the trajectory so that a status real time path of the trajectory may be reported if all the survey stations of the real time path of the trajectory and the path itself are inside the tolerance tunnel or not.

According to certain embodiments, the sub-workflow 500 may also include a safe working plan phase 508. Similar as to what is performed during the planning phase 502, the working plan phase 508 may include providing inputs for the real time path of the trajectory of the subject well, the inputs including but not limited to the original designed or selected path of the trajectory, a tolerance tunnel corresponding to the original selected path of the trajectory, a hole bottom location, targets, geometric constraints such as profiles, yield, or a combination thereof. The working plan phase 508 may also include generating one or more updated well trajectories, each updated path of the trajectory having a minimized AC risk. In certain embodiments, the working plan phase 502 may include using a safe trajectory generator. In certain embodiments, the safe trajectory generator may introduce a structured workflow that may enhance well path planning using subspace representation with risk levels. In certain embodiments, planned starting points of the updated path of the trajectory (surface, tie-in points, or bottom hole locations) may be known and targets may be defined based on the trajectory positions of nearby offset wells, including corresponding uncertainty information. The subspace that the updated path of the trajectory traverses through may be represented with risk levels such as safe, unsafe, and warning zones. In certain embodiments, the risk levels may be projected into a 1D space along original planned path of the trajectory and a 2D space on the projected normal plane at each depth of planned path. According to certain embodiments, the safe trajectory generator may include professional drilling profiles. The professional drilling profiles may connect a starting point, control points, and targets of the updated path of the trajectory to satisfy any input constraints and trajectory computation algorithms. When needed, the updated path of the trajectory may be validated or confirmed to be within a designated safe zone. In certain embodiments, a safety validator may be used to validate if the updated path of the trajectory is safe.

According to certain embodiments, the sub-workflow 500 may include a safe trajectory ranking phase 510. The trajectory ranking phase 510 may include ranking all available safe trajectories that have generated based on AC risk levels and additional criteria for example such as a deviation from plan, a trajectory length, a number of curves, max DLS constraints, and the like. Alternatively, ranking of trajectories may be based on standard rules as set forth by the industry generally or by the entity managing the wellsite specifically. A path of the trajectory may be ranked higher or more desirable if it is disposed within the subsurface that is all or mostly marked as "safe" as discussed above. In certain embodiments, a violation cost type may be predefined during the planning phase 502 taking into account all well information such as but not limited to location, risk level from offset wells, tendency uncertainties, hole bottom uncertainties, type of steering tools, type of wells, clients preferences, and the like which were derived from analysis of past offset wells drilled in the area of the subject wellsite.

Exemplary Workflow

Figure 7:
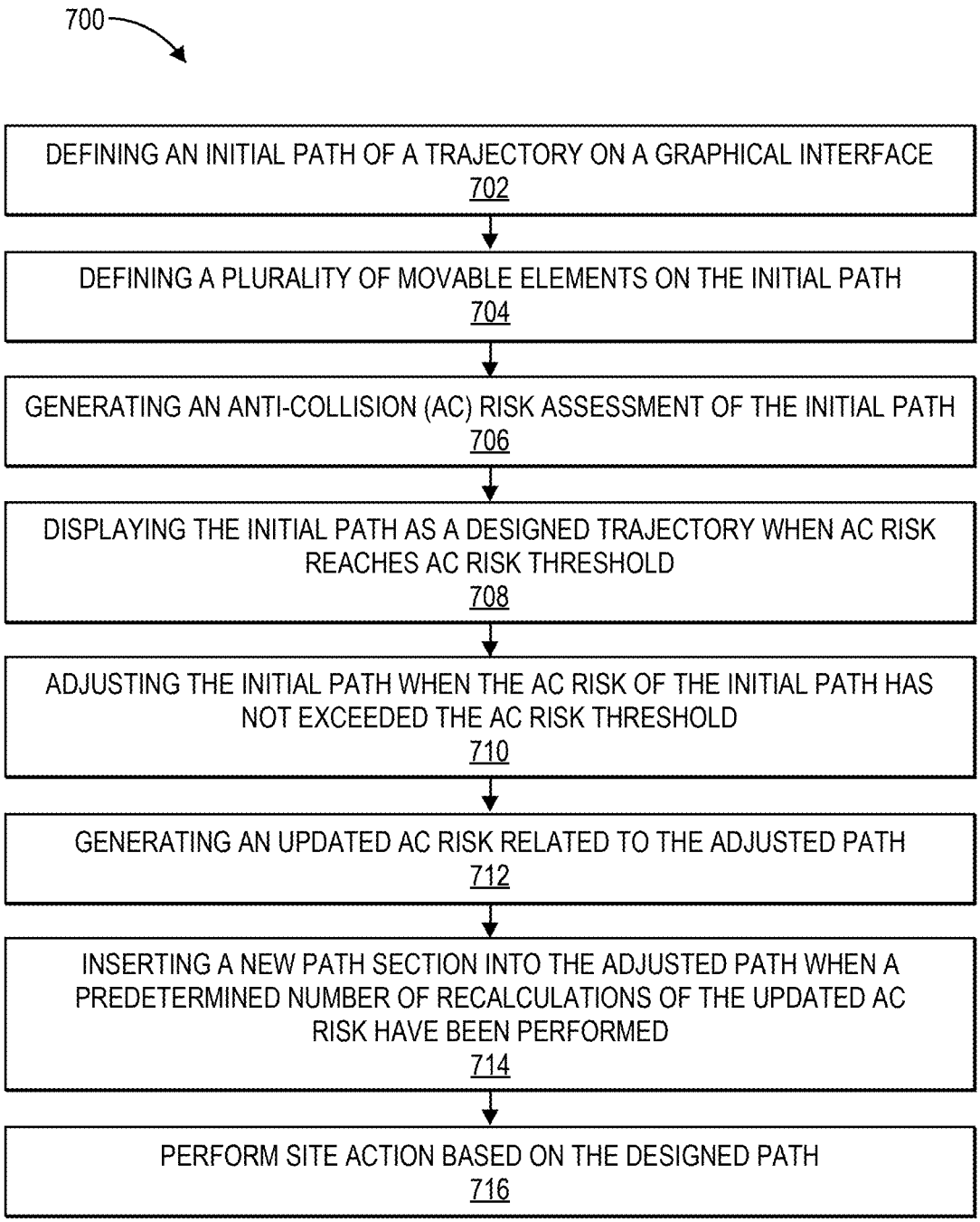
FIG. 7 illustrates a flowchart of a method for, according to an embodiment.

FIG. 7 provides an exemplary detailed method 700 for designing and monitoring a trajectory of a wellbore at a wellsite. It is appreciated that a signal processing engine stored in a memory device (e.g., transitory or non-transitory memory) may cause a computer processor to assist or otherwise facilitate execution of one or more of the various processing stages of method 700. An illustrative order of the method 700 is provided below; however, one or more portions of the method 700 may be performed in a different order, simultaneously, repeated, or omitted.

According to certain embodiments, the method 700 includes receiving a plurality of inputs related to a trajectory for a wellbore as at 702. The inputs may include a starting point, a plurality of trajectory targets, paths for offset wells with related positional uncertainty, and geometric constraints. The geometric constraints in turn may include formation information, drilling tool ability, drilling performance concerns, and production utilities.

In certain embodiments, the method 700 includes defining a zone within a subsurface beneath a wellsite as safe, as at 704.

In certain embodiments, the method 700 includes defining a first set of control points within the determined safe zone of the subsurface, as at 706.

In certain embodiments, the method 700 includes generating a proposed path of the trajectory by connecting the starting point to all trajectory targets via the first set of control points, as at 708.

In certain embodiments, the method 700 includes validating that the proposed path of the trajectory is within the determined safe zone of the subsurface, as at 710.

In certain embodiments, the method 700 includes drilling the wellbore along the proposed path of the trajectory, as at 712.

In certain embodiments, the method 700 includes monitoring a location of the wellbore as it progresses along the proposed path of the trajectory, as at 714.

In certain embodiments, the method 700 includes updating the proposed path of the trajectory in real-time when the wellbore is at risk of exiting the defined safe zone, as at 716. Updating the proposed path of the trajectory may include defining a second set of control points within the defined safe zone of the subsurface.

In certain embodiments, the method 700 includes generating an updated proposed path of the trajectory by connecting a current location of the wellbore to at least one trajectory target via the second set of control points, as at 718.

In certain embodiments, the method 700 includes drilling the wellbore along the updated proposed path of the trajectory, as at 720.

In certain embodiments, the method 700 includes performing a site action based on the updated proposed path of the trajectory, as at 722. Performing the site action may include generating or transmitting a signal that instructs or causes an action to occur. The action may include a physical action. The physical action may include selecting where to drill a wellbore in the subsurface formation, drilling the wellbore, varying a trajectory of the wellbore, varying a weight or torque on a drill bit that is drilling the wellbore, varying a rate or concentration of a fluid being pumped into the wellbore, deciding to stop drilling and pull the downhole equipment up before causing a collision with an offset well, or a combination thereof.

Exemplary Computing System

Figure 8:
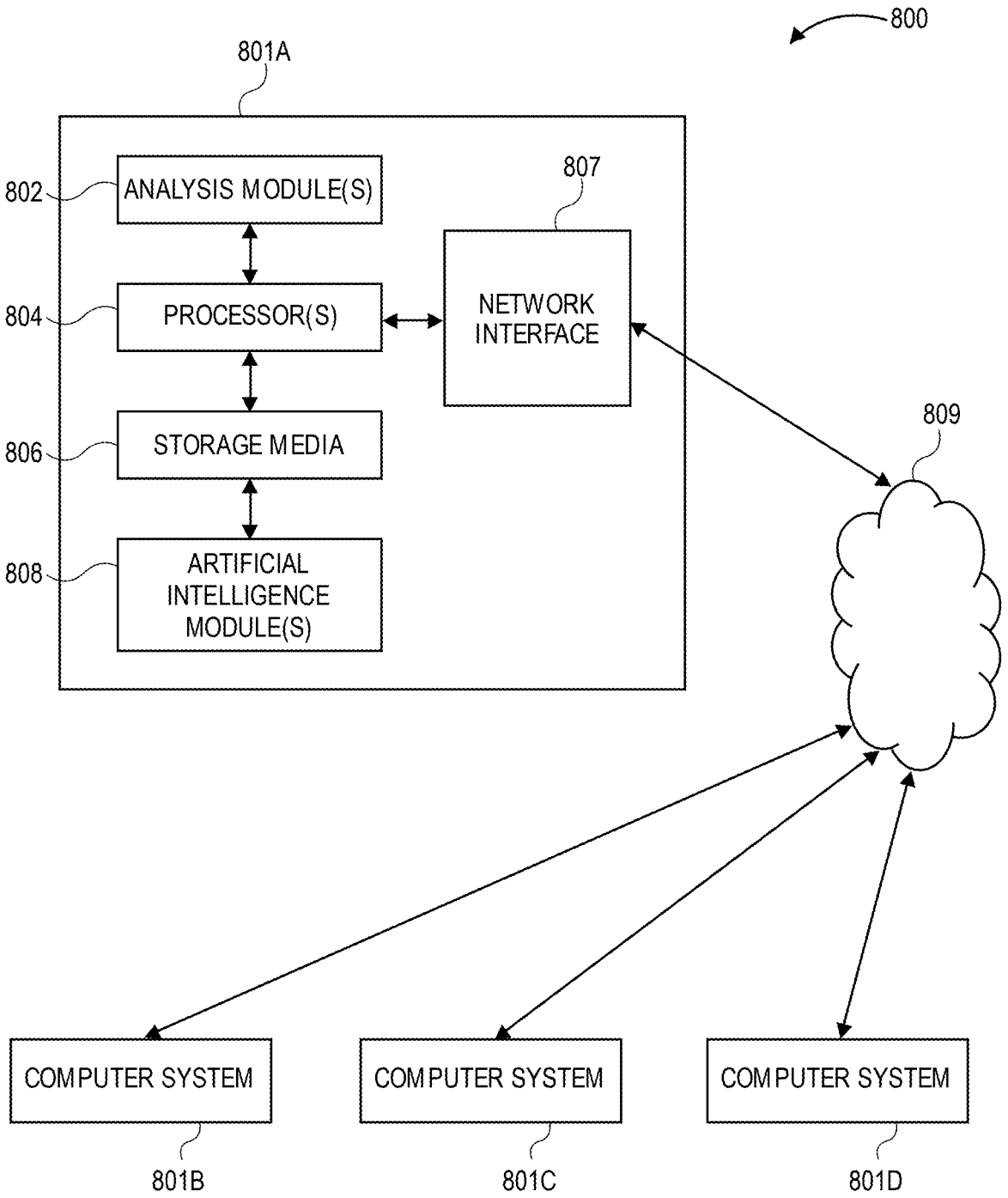
FIG. 8 illustrates a schematic view of a computing system for performing at least a portion of the method(s) described herein, according to an embodiment.

In some embodiments, the methods of the present disclosure may be executed by a computing system. FIG. 8 illustrates an example of such a computing system 800, in accordance with some embodiments. The computing system 800 may include a computer or computer system 801A, which may be an individual computer system 801A or an arrangement of distributed computer systems. The computer system 801A includes one or more analysis modules 802 that are configured to perform various tasks according to some embodiments, such as one or more methods disclosed herein. To perform these various tasks, the analysis module 802 executes independently, or in coordination with, one or more processors 804, which is (or are) connected to one or more storage media 806. The processor(s) 804 is (or are) also connected to a network interface 807 to allow the computer system 801A to communicate over a data network 809 with one or more additional computer systems and/or computing systems, such as 801B, 801C, and/or 801D (note that computer systems 801B, 801C and/or 801D may or may not share the same architecture as computer system 801A, and may be located in different physical locations, e.g., computer systems 801A and 801B may be located in a processing facility, while in communication with one or more computer systems such as 801C and/or 801D that are located in one or more data centers, and/or located in varying countries on different continents).

A processor may include a microprocessor, microcontroller, processor module or subsystem, programmable integrated circuit, programmable gate array, or another control or computing device.

The storage media 806 may be implemented as one or more computer-readable or machine-readable storage media. Note that while in the example embodiment of FIG. 8 storage media 806 is depicted as within computer system 801A, in some embodiments, storage media 806 may be distributed within and/or across multiple internal and/or external enclosures of computing system 801A and/or additional computing systems. Storage media 806 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLURAY® disks, or other types of optical storage, or other types of storage devices. Note that the instructions discussed above may be provided on one computer-readable or machine-readable storage medium, or may be provided on multiple computer-readable or machine-readable storage media distributed in a large system having possibly plural nodes. Such computer-readable or machine-readable storage medium or media is (are) considered to be part of an article (or article of manufacture). An article or article of manufacture may refer to any manufactured single component or multiple components. The storage medium or media may be located either in the machine running the machine-readable instructions, or located at a remote site from which machine-readable instructions may be downloaded over a network for execution.

It should be appreciated that computing system 800 is merely one example of a computing system, and that computing system 800 may have more or fewer components than shown, may combine additional components not depicted in the example embodiment of FIG. 8, and/or computing system 800 may have a different configuration or arrangement of the components depicted in FIG. 8. The various components shown in FIG. 8 may be implemented in hardware, software, or a combination of both hardware and software, including one or more signal processing and/or application specific integrated circuits.

Further, the steps in the processing methods described herein may be implemented by running one or more functional modules in information processing apparatus such as general purpose processors or application specific chips, such as ASICs, FPGAs, PLDs, or other appropriate devices. These modules, combinations of these modules, and/or their combination with general hardware are included within the scope of the present disclosure.

Computational interpretations, models, and/or other interpretation aids may be refined in an iterative fashion; this concept is applicable to the methods discussed herein. This may include use of feedback loops executed on an algorithmic basis, such as at a computing device (e.g., computing system 800, FIG. 8), and/or through manual control by a user who may make determinations regarding whether a given step, action, template, model, or set of curves has become sufficiently accurate for the evaluation of the risk index.

The steps in the processing methods described above may be implemented by running one or more functional modules in information processing apparatus such as general purpose processors or application specific chips, such as ASICs, FPGAs, PLDs, or other appropriate devices. These modules, combinations of these modules, and/or their combination with general hardware are included within the scope of this disclosure.

Of course, many processing techniques for collected data, including one or more of the techniques and methods disclosed herein, may also be used successfully with collected data types other than seismic or other subsurface modeling data. While certain implementations have been disclosed in the context of seismic or other subsurface data collection and processing, those with skill in the art will recognize that one or more of the methods, techniques, and computing systems disclosed herein can be applied in many fields and contexts where data involving structures arrayed in a multi-dimensional space and/or subsurface region of interest may be collected and processed, e.g., medical imaging techniques such as tomography, ultrasound, MRI and the like for human tissue; radar, sonar, and LIDAR imaging techniques; mining area surveying and monitoring, oceanographic surveying and monitoring, and other appropriate multi-dimensional imaging problems.

Some examples of equations and mathematical expressions may have been provided in this disclosure. But those with skill in the art will appreciate that variations of these expressions and equations, alternative forms of these expressions and equations, and related expressions and equations that can be derived from the example equations and expressions provided herein may also be successfully used to perform the methods, techniques, and workflows related to the embodiments disclosed herein.

The foregoing description, for purposes of explanation, has been described with reference to specific embodiments. However, the illustrative discussions above are not intended to be exhaustive or to limit the described embodiments to the precise forms disclosed. Many modifications and variations are possible in view of the above teachings. The embodiments were chosen and described in order to explain the principles of this disclosure and its practical applications, to thereby enable others skilled in the art to use the disclosed approach and various embodiments with various modifications as are suited to the particular use contemplated.

What is claimed is:

1. A method for designing, monitoring, and updating a trajectory of a wellbore at a wellsite, the method comprising:

receiving a plurality of inputs related to the trajectory for the wellbore, wherein the plurality of inputs comprises a starting point of the trajectory;

defining a zone of a subsurface beneath the wellsite as safe;

defining a first set of control points within the zone of the subsurface;

generating a proposed path of the trajectory by connecting the starting point of the trajectory to a plurality of trajectory targets via the first set of control points, wherein each control point of the first set of control points is visually represented on a graphical user interface as a point on the proposed path within the zone of the subsurface;

drilling the wellbore along the proposed path of the trajectory;

monitoring a location of the wellbore as it progresses along the proposed path of the trajectory;

updating the proposed path of the trajectory in real-time with the drilling, wherein updating the proposed path of the trajectory comprises:

defining a second set of control points within the zone of the subsurface, the second set of control points comprising a movable joint point; and displaying the movable joint point on the graphical user interface in a first position such that the movable joint point is outside the proposed path;

generating an updated proposed path of the trajectory by connecting the location of the wellbore to at least one of the plurality of trajectory targets via the second set of control points;

displaying the movable joint point on the graphical user interface in a second position such that the movable joint point is outside the proposed path and outside the updated proposed path;

drilling the wellbore along the updated proposed path of the trajectory; and performing a site action based on the updated proposed path of the trajectory, wherein:

performing the site action comprises generating or transmitting a signal that instructs or causes an action to occur; and the site action comprises a physical action, the physical action comprising at least one of:

the drilling the wellbore along the updated proposed path of the trajectory;

varying a weight or torque on a drill bit that is drilling the wellbore;

varying a rate or concentration of a fluid being pumped into the wellbore; or stopping the drilling.

2. The method of claim 1, wherein defining the zone of the subsurface beneath the wellsite as safe comprises generating a tolerance tunnel surrounding the proposed path of the trajectory in 3D space.

3. The method of claim 1, wherein the plurality of inputs comprises:

a plurality of trajectory targets; and a plurality of paths corresponding to a plurality offset wells, the plurality of offset wells comprising:

related positional uncertainties; and geometric constraints.

4. The method of claim 3, wherein the geometric constraints comprise formation information.

5. A computing system, comprising:

one or more processors;

a memory system comprising one or more non-transitory computer-readable media storing instructions that, when executed by at least one of the one or more processors, cause the computing system to perform operations, the operations comprising:

receiving a plurality of inputs related to a trajectory for a wellbore, wherein the inputs comprise a starting point of the trajectory;

defining a zone of a subsurface beneath a wellsite as safe;

defining a first set of control points within the zone of the subsurface;

generating a proposed path of the trajectory by connecting the starting point of the trajectory to a plurality of trajectory targets via the first set of control points, wherein each control point of the first set of control points is visually represented on a graphical user interface as a point on the proposed path within the zone of the subsurface;

drilling the wellbore along the proposed path of the trajectory;

monitoring a location of the wellbore as it progresses along the proposed path of the trajectory;

updating the proposed path of the trajectory in real-time with the drilling, wherein updating the proposed path of the trajectory comprises:

defining a second set of control points within the zone of the subsurface, the second set of control points comprising a movable joint point; and displaying the movable joint point on the graphical user interface in a first position such that the movable joint point is outside the proposed path;

generating an updated proposed path of the trajectory by connecting the location of the wellbore to at least one of the plurality of trajectory targets via the second set of control points;

displaying the movable joint point on the graphical user interface in a second position such that the movable joint point is outside the proposed path and outside the updated proposed path;

drilling the wellbore along the updated proposed path of the trajectory; and performing a site action based on the updated proposed path of the trajectory, wherein performing the site action comprises generating or transmitting a signal that instructs or causes an action to occur, the action comprising at least one of:

the drilling the wellbore along the updated proposed path of the trajectory;

varying a weight or torque on a drill bit that is drilling the wellbore;

varying a rate or concentration of a fluid being pumped into the wellbore; or stopping the drilling and pulling downhole equipment up before causing a collision with an offset well.

6. The computing system of claim 5, wherein defining the zone of the subsurface beneath the wellsite as safe comprises defining a tolerance line with a predetermined depth range related to the trajectory of the wellbore.

7. The computing system of claim 6, further comprising expanding the tolerance line to form a tolerance tunnel around the trajectory of the wellbore.

8. The computing system of claim 7, wherein defining the first set of control points within the zone of the subsurface comprises defining the first set of control points within the tolerance tunnel.

9. The computing system of claim 5, wherein the operations further comprise filtering out at least one of the first set of control points based on a set of constraints applied before generating the proposed path of the trajectory.

10. The computing system of claim 9, wherein the set of constraints comprises an inclination range corresponding to a predetermined depth of the proposed path of the trajectory, or a dogleg severity of the proposed path of the trajectory.

11. A non-transitory computer-readable medium storing instructions that, when executed by one or more processors of a computing system, cause the computing system to perform operations, the operations comprising:

receiving a plurality of inputs related to a trajectory for a wellbore at a wellsite, wherein:

the plurality of inputs comprises:

a starting point;

a plurality of trajectory targets; and a plurality of paths corresponding to a plurality offset wells, the plurality of offset wells comprising:

related positional uncertainties; and geometric constraints; and the geometric constraints comprise formation information;

defining a zone of a subsurface beneath the wellsite as safe;

defining a first set of control points within the zone of the subsurface;

generating a proposed path of the trajectory by connecting the starting point to each of the plurality of trajectory targets via the first set of control points, wherein each control point of the first set of control points is visually represented on a graphical user interface as a point on the proposed path within the zone of the subsurface;

drilling the wellbore along the proposed path of the trajectory;

monitoring a location of the wellbore as it progresses along the proposed path of the trajectory;

updating the proposed path of the trajectory in real-time with the drilling wherein updating the proposed path of the trajectory comprises:

defining a second set of control points within the zone of the subsurface, the second set of control points comprising a movable joint point; and displaying the movable joint point on the graphical user interface in a first position such that the movable joint point is outside the proposed path:

generating an updated proposed path of the trajectory by connecting the location of the wellbore to at least one of the plurality of trajectory targets via the second set of control points;

displaying the movable joint point on the graphical user interface in a second position such that the movable joint point is outside the proposed path and outside the updated proposed path;

drilling the wellbore along the updated proposed path of the trajectory; and performing a site action based on the updated proposed path of the trajectory, wherein:

performing the site action comprises generating or transmitting a signal that instructs or causes an action to occur; and the site action comprises a physical action, the physical action comprising at least one of:

the drilling the wellbore along the updated proposed path of the trajectory;

varying a weight or torque on a drill bit that is drilling the wellbore;

varying a rate or concentration of a fluid being pumped into the wellbore; or stopping the drilling and pulling downhole equipment up before causing a collision with an offset well.

* * * * *